US009555289B2

(12) United States Patent
Mimura et al.

(10) Patent No.: US 9,555,289 B2
(45) Date of Patent: Jan. 31, 2017

(54) GOLF BALL

(71) Applicant: DUNLOP SPORTS CO. LTD., Kobe-shi, Hyogo (JP)

(72) Inventors: Kohei Mimura, Kobe (JP); Takahiro Sajima, Kobe (JP); Hyoungchol Kim, Kobe (JP); Masahide Onuki, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/749,200

(22) Filed: Jun. 24, 2015

(65) Prior Publication Data

US 2015/0375049 A1 Dec. 31, 2015

(30) Foreign Application Priority Data

Jun. 25, 2014 (JP) ..... 2014-129815

(51) Int. Cl.
*A63B 37/06* (2006.01)
*A63B 37/00* (2006.01)

(52) U.S. Cl.
CPC ..... *A63B 37/0018* (2013.01); *A63B 37/002* (2013.01); *A63B 37/009* (2013.01); *A63B 37/0017* (2013.01); *A63B 37/0019* (2013.01); *A63B 37/0021* (2013.01); *A63B 37/0096* (2013.01)

(58) Field of Classification Search
CPC ..... A63B 37/009
USPC ..... 473/383–384
See application file for complete search history.

(56) References Cited

U.S. PATENT DOCUMENTS

| | | | | |
|---|---|---|---|---|
| 5,782,702 | A | 7/1998 | Yamagishi et al. | |
| 5,782,703 | A | 7/1998 | Yamagishi et al. | |
| 2010/0062876 | A1* | 3/2010 | Shinohara | A63B 37/0031 473/376 |

FOREIGN PATENT DOCUMENTS

| | | | |
|---|---|---|---|
| JP | 5-103846 | A | 4/1993 |
| JP | 10-43342 | A | 2/1998 |
| JP | 10-43343 | A | 2/1998 |
| JP | 2000-107338 | A | 4/2000 |

* cited by examiner

*Primary Examiner* — Raeann Gorden
(74) *Attorney, Agent, or Firm* — Birch, Stewart, Kolasch & Birch, LLP

(57) ABSTRACT

A golf ball has a large number of dimples on a surface thereof. The golf ball meets the following mathematical formula (I): $1.320 \leq L1 \leq 1.420$ (I), where L1 represents a ratio of a lift coefficient CL1 which is measured under conditions of a Reynolds number of $1.290 \times 10^5$ and a spin rate of 2820 rpm, relative to a lift coefficient CL2 which is measured under conditions of a Reynolds number of $1.290 \times 10^5$ and a spin rate of 1740 rpm.

4 Claims, 8 Drawing Sheets

GOLF BALL

This application claims priority on Patent Application No. 2014-129815 filed in JAPAN on Jun. 25, 2014. The entire contents of this Japanese Patent Application are hereby incorporated by reference.

BACKGROUND OF THE INVENTION

Field of the Invention

The present invention relates to golf balls. Specifically, the present invention relates to improvement of aerodynamic characteristics of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

JPH5-103846 discloses a golf ball which has dimples the diameters, the depths, and the number of which are made appropriate.

U.S. Pat. No. 5,782,703 (JPH10-43342) discloses a golf ball which has dimples the ratio of the diameter and the depth of each of which is made appropriate.

U.S. Pat. No. 5,782,702 (JPH10-43343) discloses a golf ball in which the ratio of the volumes of dimples relative to the volume of the ball is made appropriate.

JP2000-107338 discloses a golf ball having a diameter and a weight which are made appropriate.

When a golf ball is hit at the vicinity of the center of the face of a club head, the kinetic energy of the club head is sufficiently transferred to the golf ball. With this hit, the spin rate of the golf ball is generally appropriate.

A hitting point on a face varies at each shot. In particular, the hitting point greatly varies at each shot of an amateur golf player. The variation in hitting point causes variation in spin rate.

In a conventional golf ball, the specifications of dimples are determined such that a large flight distance is achieved under an appropriate spin rate condition. With the golf ball, a large flight distance is not achieved when a spin rate is not appropriate. In the golf ball, variation in hitting point causes variation in spin rate, and the variation in spin rate causes variation in flight distance. A golf player who uses a golf ball having great variation in flight distance has difficulty in causing the golf ball to stop at a target point.

Golf players desire golf balls having less flight distance's dependency on a spin rate. In other words, golf players desire golf balls having excellent flight distance stability. An object of the present invention is to provide a golf ball having excellent flight distance stability.

SUMMARY OF THE INVENTION

A golf ball according to the present invention has a large number of dimples on a surface thereof. The golf ball meets the following mathematical formula (I):

$$1.320 \leq L1 \leq 1.420 \quad \text{(I)},$$

where L1 represents a ratio of a lift coefficient CL1 which is measured under conditions of a Reynolds number of $1.290\times10^5$ and a spin rate of 2820 rpm, relative to a lift coefficient CL2 which is measured under conditions of a Reynolds number of $1.290\times10^5$ and a spin rate of 1740 rpm.

In the golf ball according to the present invention, the difference between a flight distance achieved when a spin rate is high and a flight distance achieved when a spin rate is low is small. In other words, the golf ball has excellent flight distance stability. A golf player easily lands the golf ball at a target point.

Preferably, the golf ball meets the following mathematical formula (II):

$$1.240 \leq L2 \leq 1.340 \quad \text{(II)},$$

where L2 represents a ratio of a lift coefficient CL3 which is measured under conditions of a Reynolds number of $1.771\times10^5$ and a spin rate of 2940 rpm, relative to a lift coefficient CL4 which is measured under conditions of a Reynolds number of $1.771\times10^5$ and a spin rate of 1800 rpm.

Preferably, a ratio (L1/L2) of the L1 relative to the L2 is equal to or greater than 1.000. Preferably, the ratio (L1/L2) is equal to or greater than 1.060.

Preferably, a total volume of the dimples is equal to or greater than 520 $mm^3$ but equal to or less than 720 $mm^3$.

Preferably, a ratio of a sum of spherical surface areas s of the dimples relative to a surface area of a phantom sphere of the golf ball is equal to or greater than 0.780 but equal to or less than 0.950.

Preferably, a total number of the dimples is equal to or greater than 250 but equal to or less than 450.

Preferably, each dimple has a diameter of equal to or greater than 2.0 mm but equal to or less than 6.0 mm.

Preferably, each dimple has a depth of equal to or greater than 0.10 mm but equal to or less than 0.60 mm.

DESCRIPTION OF THE PREFERRED EMBODIMENTS

The following will describe in detail the present invention, based on preferred embodiments with reference to the accompanying drawings.

Figure 1:
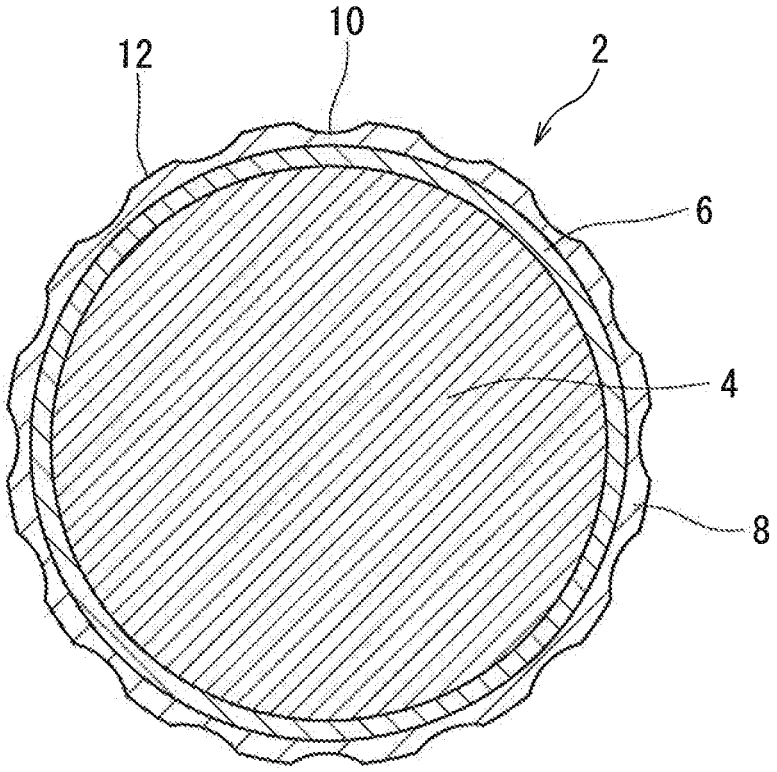
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing.

The golf ball 2 preferably has a diameter of equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, a dispersant, a carboxylic acid, a carboxylate, and the like. The rubber composition may include synthetic resin powder or crosslinked rubber powder.

The core 4 has a diameter of preferably equal to or greater than 30.0 mm and particularly preferably equal to or greater than 38.0 mm. The diameter of core 4 is preferably equal to or less than 42.0 mm and particularly preferably equal to or less than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably equal to or greater than 0.2 mm and particularly preferably equal to or greater than 0.3 mm. The thickness of the mid layer 6 is preferably equal to or less than 2.5 mm and particularly preferably equal to or less than 2.2 mm. The mid layer 6 has a specific gravity of preferably equal to or greater than 0.90 and particularly preferably equal to or greater than 0.95. The specific gravity of the mid layer 6 is preferably equal to or less than 1.10 and particularly preferably equal to or less than 1.05. The mid layer 6 may have two or more layers.

The cover 8 is formed from a resin composition. A preferable base polymer of the resin composition is a polyurethane. The resin composition may include a thermoplastic polyurethane or may include a thermosetting polyurethane. In light of productivity, the thermoplastic polyurethane is preferred. The thermoplastic polyurethane includes a polyurethane component as a hard segment, and a polyester component or a polyether component as a soft segment.

Examples of an isocyanate for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, the resin composition of the cover 8 may include another polymer. Examples of the other polymer include ionomer resins, polystyrenes, polyamides, polyesters, and polyolefins. The resin composition may include two or more polymers.

The resin composition of the cover 8 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 8 has a thickness of preferably equal to or greater than 0.2 mm and particularly preferably equal to or greater than 0.3 mm. The thickness of the cover 8 is preferably equal to or less than 2.5 mm and particularly preferably equal to or less than 2.2 mm. The cover 8 has a specific gravity of preferably equal to or greater than 0.90 and particularly preferably equal to or greater than 0.95. The specific gravity of the cover 8 is preferably equal to or less than 1.10 and particularly preferably equal to or less than 1.05. The cover 8 may have two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. Examples of the base polymer of the reinforcing layer include two-component curing type epoxy resins and two-component curing type urethane resins.

Figure 2:
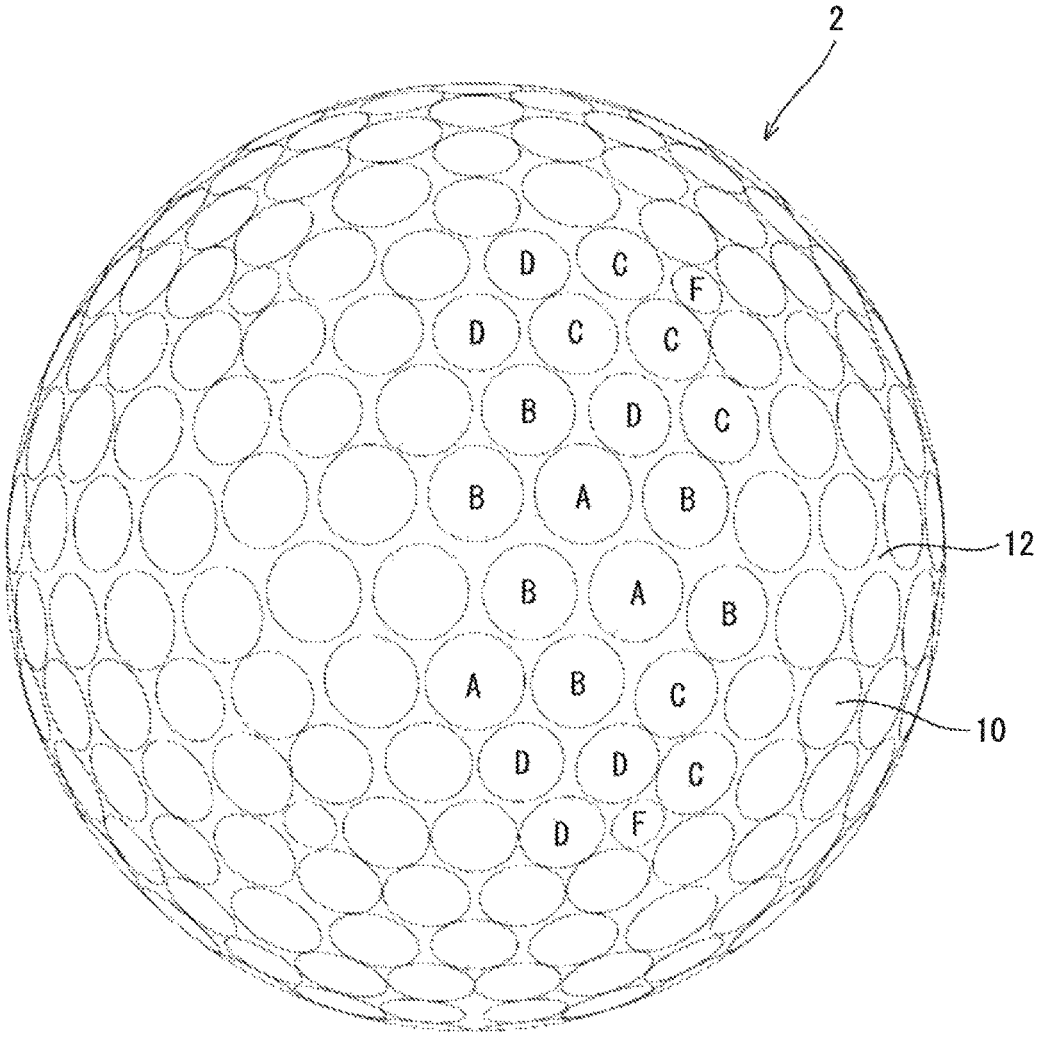
FIG. 2 is an enlarged front view of the golf ball in FIG. 1.
Figure 3:
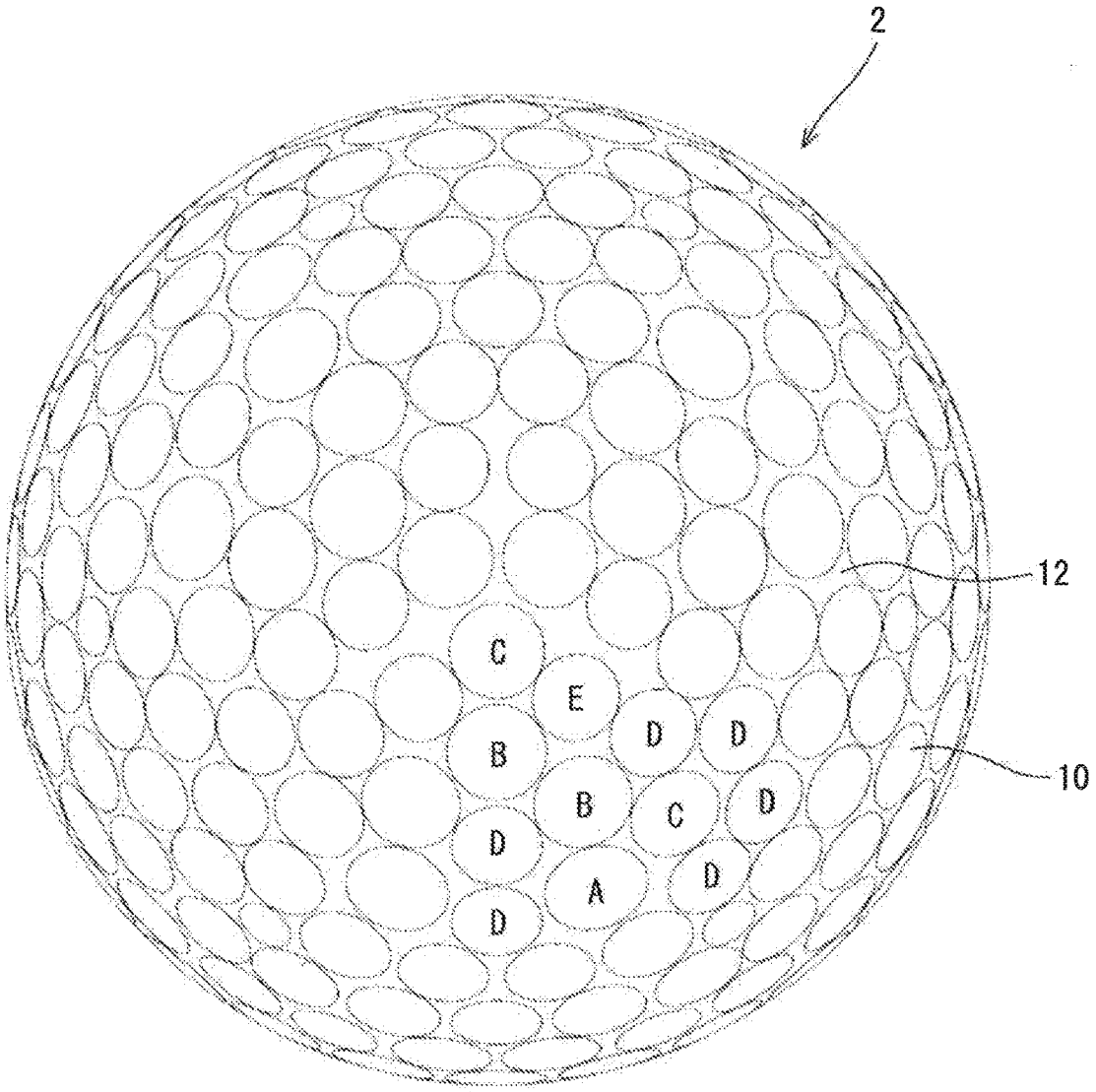
FIG. 3 is a plan view of the golf ball in FIG. 2.

As shown in FIGS. 2 and 3, the contour of each dimple is circular. The golf ball 2 has dimples A each having a diameter of 4.6 mm; dimples B each having a diameter of 4.4 mm; dimples C each having a diameter of 4.2 mm; dimples D each having a diameter of 4.0 mm; dimples E each having a diameter of 3.9 mm; and dimples F each having a diameter of 2.6 mm. The number of types of the dimples 10 is six. The golf ball 2 may have non-circular dimples instead of the circular dimples 10 or together with circular dimples 10.

The number of the dimples A is 42; the number of the dimples B is 72; the number of the dimples C is 66; the number of the dimples D is 126; the number of the dimples E is 12; and the number of the dimples F is 12. The total number of the dimples 10 is 330.

Figure 4:
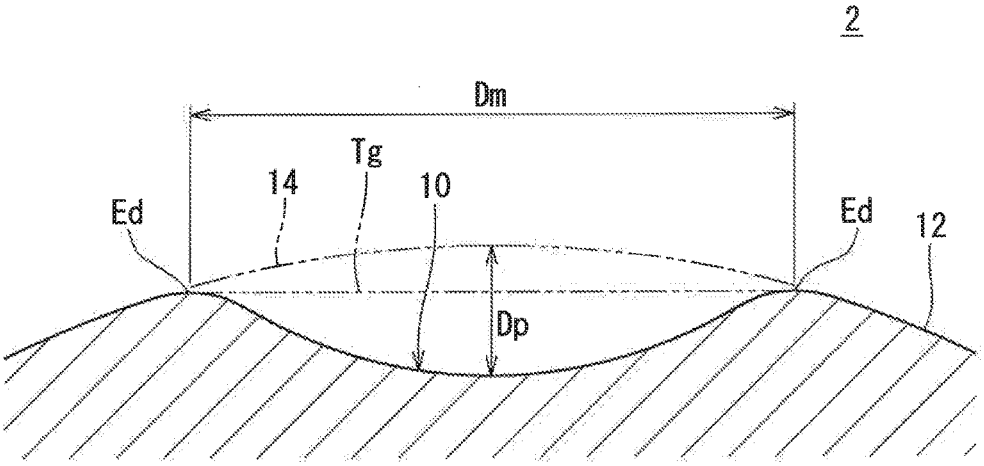
FIG. 4 is a partially enlarged cross-sectional view of the golf ball in FIG. 1.

FIG. 4 shows a cross section along a plane passing through the center of the dimple 10 and the center of the golf ball 2. In FIG. 4, the top-to-bottom direction is the depth direction of the dimple 10. In FIG. 4, what is indicated by a chain double-dashed line is a phantom sphere 14. The surface of the phantom sphere 14 is the surface of the golf ball 2 when it is postulated that no dimple 10 exists. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 4, what is indicated by a double ended arrow Dm is the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 4, what is indicated by a double ended arrow Dp is the depth of the dimple 10. The depth Dp is the distance between the deepest part of the dimple 10 and the phantom sphere 14.

The diameter Dm of each dimple 10 is preferably equal to or greater than 2.0 mm but equal to or less than 6.0 mm. The dimple 10 having a diameter Dm of equal to or greater than 2.0 mm contributes to turbulization. In this respect, the diameter Dm is more preferably equal to or greater than 2.5 mm and particularly preferably equal to or greater than 2.8 mm. The dimple 10 having a diameter Dm of equal to or less than 6.0 mm does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the depth Dp of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.60 mm and particularly preferably equal to or less than 0.55 mm.

The spherical surface area s of each dimple 10 is the area of a zone surrounded by the contour line of the dimple 10, of the surface of the phantom sphere 14 of the golf ball 2. In the golf ball 2 shown in FIGS. 2 and 3, the spherical surface area s of each dimple A is 16.61 $mm^2$; the spherical surface area s of each dimple B is 15.20 $mm^2$; the spherical surface area s of each dimple C is 13.85 $mm^2$; the spherical surface area s of each dimple D is 12.56 $mm^2$; the spherical surface area s of each dimple E is 11.94 $mm^2$; and the spherical surface area s of each dimple F is 5.31 $mm^2$.

The ratio of the sum of the spherical surface areas s of all the dimples 10 to the surface area of the phantom sphere 14 is referred to as an occupation ratio. In light of turbulization, the occupation ratio is preferably equal to or greater than 0.780, more preferably equal to or greater than 0.800, and particularly preferably equal to or greater than 0.840. The occupation ratio is preferably equal to or less than 0.950. In the golf ball 2 shown in FIGS. 2 and 3, the sum of the spherical surface areas s is 4495.3 $mm^2$. The surface area of the phantom sphere 14 of the golf ball 2 is 5728.0 $mm^2$, and thus the occupation ratio is 0.785.

From the standpoint that a sufficient occupation ratio is achieved, the total number of the dimples 10 is preferably equal to or greater than 250, more preferably equal to or greater than 280, and particularly preferably equal to or greater than 300. From the standpoint that each dimple 10 can contribute to turbulization, the total number of the dimples 10 is preferably equal to or less than 450, more preferably equal to or less than 400, and particularly preferably equal to or less than 380.

In the present invention, the "volume of the dimple" means the volume of a portion surrounded by the phantom sphere 14 and the surface of the dimple 10. In light of suppression of rising of the golf ball 2 during flight, the total volume of all the dimples 10 is preferably equal to or greater than 480 $mm^3$, more preferably equal to or greater than 500 $mm^3$, and particularly preferably equal to or greater than 520 $mm^3$. In light of suppression of dropping of the golf ball 2 during flight, the total volume is preferably equal to or less than 750 $mm^3$, more preferably equal to or less than 730 $mm^3$, and particularly preferably equal to or less than 720 $mm^3$.

The golf ball 2 meets the following mathematical formula (I):

$$1.320 \leq L1 \leq 1.420 \quad \text{(I)},$$

where L1 represents the ratio (CL1/CL2) of a lift coefficient CL1 and a lift coefficient CL2. The lift coefficient CL1 and the lift coefficient CL2 are measured according to the ITR (Indoor Test Range) determined by the USGA. The lift coefficient CL1 is measured under conditions of a Reynolds number of $1.290 \times 10^5$ and a spin rate of 2820 rpm. The lift coefficient CL2 is measured under conditions of a Reynolds number of $1.290 \times 10^5$ and a spin rate of 1740 rpm.

A Reynolds number is a dimensionless number used in the field of fluid mechanics. A Reynolds number (Re) can be calculated by the following mathematical formula:

$$Re = \rho v L / \mu,$$

where ρ represents the density of a fluid, v represents a speed of an object, L represents a characteristic length, and μ represents a viscosity coefficient of the fluid.

As described above, the Reynolds number at the measurements of the lift coefficients CL1 and CL2 is $1.290 \times 10^5$. Regarding the golf ball 2 which flies in the air, this Reynolds number corresponds to flight at a relatively low speed. As described above, the spin rate at the measurement of the lift coefficient CL1 is 2820 rpm. This spin rate is relatively high. As described above, the spin rate at the measurement of the lift coefficient CL2 is 1740 rpm. This spin rate is relatively low. The lift coefficients CL1 and CL2 correspond to lift coefficients under the following conditions, respectively.

CL1: a condition that the golf ball 2 that is hit by a golf player having a low head speed flies at a high spin rate (condition 1).

CL2: a condition that the golf ball 2 that is hit by a golf player having a low head speed flies at a low spin rate (condition 2).

According to the finding by the present inventor, the golf ball 2 that meets the mathematical formula (I) has excellent flight distance stability when being launched at a low speed. In other words, the golf ball 2 in which L1 is equal to or greater than 1.320 but equal to or less than 1.420 has excellent flight distance stability when being launched at a low speed.

In the golf ball 2 in which L1 is equal to or greater than 1.320, the lift force under the condition 1 is not excessively small, and the lift force under the condition 2 is not excessively great. In this respect, L1 is more preferably equal to or greater than 1.330 and particularly preferably equal to or greater than 1.340. In the golf ball 2 in which L1 is equal to or less than 1.420, the lift force under the condition 1 is not excessively great, and the lift force under the condition 2 is not excessively small. In this respect, L1 is more preferably equal to or less than 1.400 and particularly preferably equal to or less than 1.390.

L1 can be achieved in the above range by making the specifications of the dimples 10 appropriate. Specifically, L1 can be achieved in the above range by means such as:

(1) making the depth of each dimple 10 appropriate;

(2) making the area of each dimple 10 appropriate;

(3) making the volume of each dimple 10 appropriate;

(4) making the number of the dimples 10 appropriate;

(5) making the occupation ratio of the dimples 10 appropriate; and the like.

Preferably, the golf ball 2 meets the following mathematical formula (II):

$$1.240 \leq L2 \leq 1.340 \quad \text{(II)},$$

where L2 represents the ratio (CL3/CL4) of a lift coefficient CL3 and a lift coefficient CL4. The lift coefficient CL3 and the lift coefficient CL4 are measured according to the ITR (Indoor Test Range) determined by the USGA. The lift coefficient CL3 is measured under conditions of a Reynolds number of $1.771\times10^5$ and a spin rate of 2940 rpm. The lift coefficient CL4 is measured under conditions of a Reynolds number of $1.771\times10^5$ and a spin rate of 1800 rpm.

The Reynolds number at the measurements of the lift coefficients CL3 and CL4 is $1.771\times10^5$. Regarding the golf ball 2 which flies in the air, this Reynolds number corresponds to flight at a relatively high speed. As described above, the spin rate at the measurement of the lift coefficient CL3 is 2940 rpm. This spin rate is relatively high. As described above, the spin rate at the measurement of the lift coefficient CL4 is 1800 rpm. This spin rate is relatively low. The lift coefficients CL3 and CL4 correspond to lift coefficients under the following conditions, respectively.

CL3: a condition that the golf ball 2 that is hit by a golf player having a high head speed flies at a high spin rate (condition 3).

CL4: a condition that the golf ball 2 that is hit by a golf player having a high head speed flies at a low spin rate (condition 4).

According to the finding by the present inventor, the golf ball 2 that meets the mathematical formula (II) has excellent flight distance stability when being launched at a high speed. In other words, the golf ball 2 in which L2 is equal to or greater than 1.240 but equal to or less than 1.340 has excellent flight distance stability when being launched at a high speed.

In the golf ball 2 in which L2 is equal to or greater than 1.240, the lift force under the condition 3 is not excessively small, and the lift force under the condition 4 is not excessively great. In this respect, L2 is more preferably equal to or greater than 1.260 and particularly preferably equal to or greater than 1.290. In the golf ball 2 in which L2 is equal to or less than 1.340, the lift force under the condition 3 is not excessively great, and the lift force under the condition 4 is not excessively small. In this respect, L2 is more preferably equal to or less than 1.330 and particularly preferably equal to or less than 1.320.

L2 can be achieved in the above range by making the specifications of the dimples 10 appropriate. Specifically, L2 can be achieved in the above range by means such as:

(1) making the depth of each dimple 10 appropriate;

(2) making the area of each dimple 10 appropriate;

(3) making the volume of each dimple 10 appropriate;

(4) making the number of the dimples 10 appropriate;

(5) making the occupation ratio of the dimples 10 appropriate; and the like.

The ratio (L1/L2) of L1 relative to L2 is preferably equal to or greater than 1.000. With the golf ball 2 in which the ratio (L1/L2) is equal to or greater than 1.000, under both a low speed condition and a high speed condition, even when a spin rate varies, a flight distance is less likely to vary. In this respect, the ratio (L1/L2) is particularly preferably equal to or greater than 1.060.

EXAMPLES

Example 1

A rubber composition was obtained by kneading 100 parts by weight of a high-cis polybutadiene (trade name "BR-730", manufactured by JSR Corporation), 22.5 parts by weight of zinc diacrylate, 5 parts by weight of zinc oxide, parts by weight of barium sulfate, 0.5 parts by weight of diphenyl disulfide, and 0.6 parts by weight of dicumyl peroxide. This rubber composition was placed into a mold including upper and lower mold halves each having a hemispherical cavity, and heated at 170° C. for 18 minutes to obtain a core with a diameter of 38.5 mm.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin ("Himilan AM7329", manufactured by Du Pont-MITSUI POLYCHEMICALS Co., Ltd.), and 4 parts by weight of titanium dioxide with a twin-screw kneading extruder. The core was covered with the resin composition by injection molding to form a mid layer with a thickness of 1.6 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g. The amount of compressive deformation that was measured with a YAMADA type compression tester in the case where a load was 98 N to 1274 N was 4.10 mm. The specifications of the dimples of the golf ball are shown in Table 1 below.

Examples 2 and 3 and Comparative Examples 1 to 4

Golf balls of Examples 2 and 3 and Comparative Examples 1 to 4 were obtained in the same manner as Example 1, except the specifications of the dimples were as shown in Tables 1 and 2 below.

Examples 4 to 7

Figure 5:
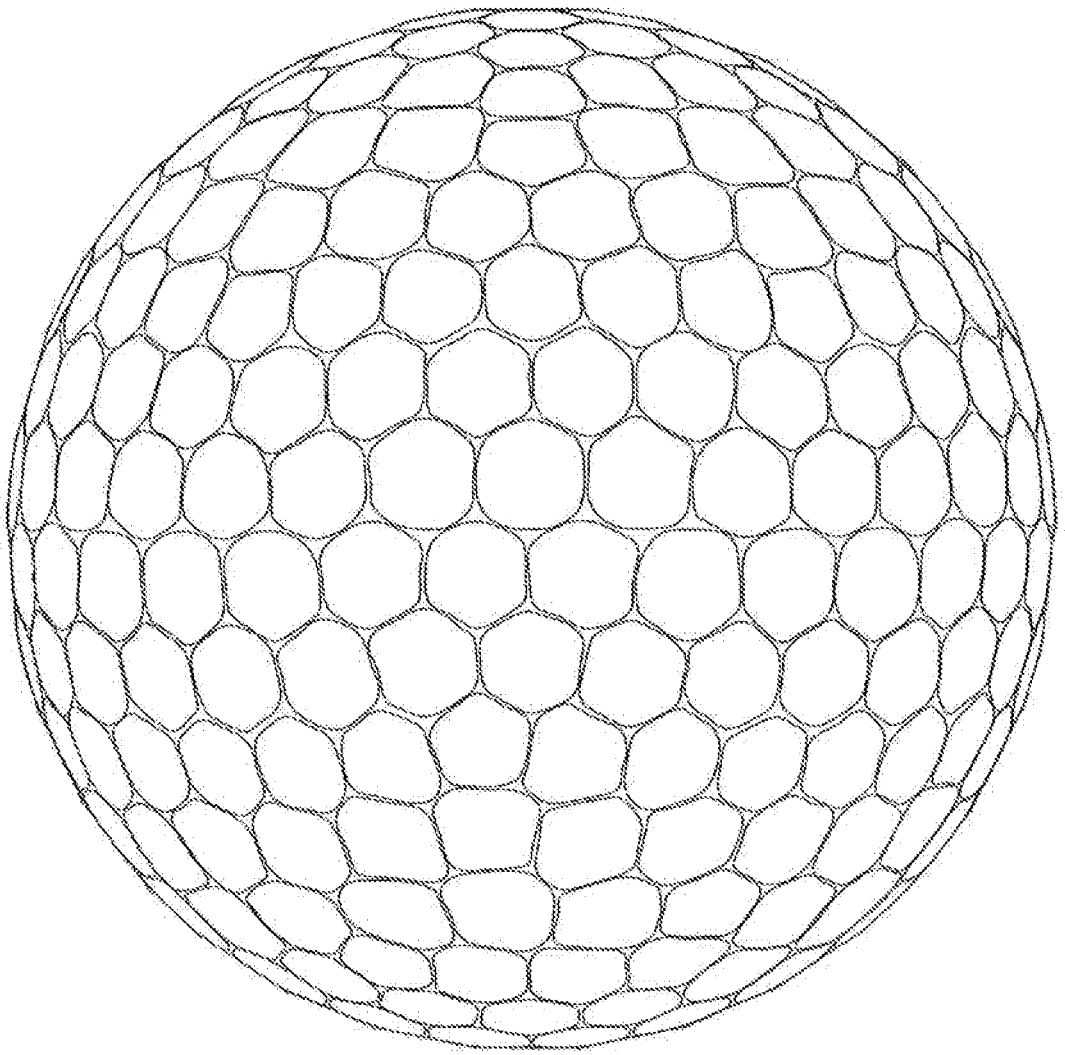
FIG. 5 is a front view of a golf ball according to Example 4 of the present invention.
Figure 6:
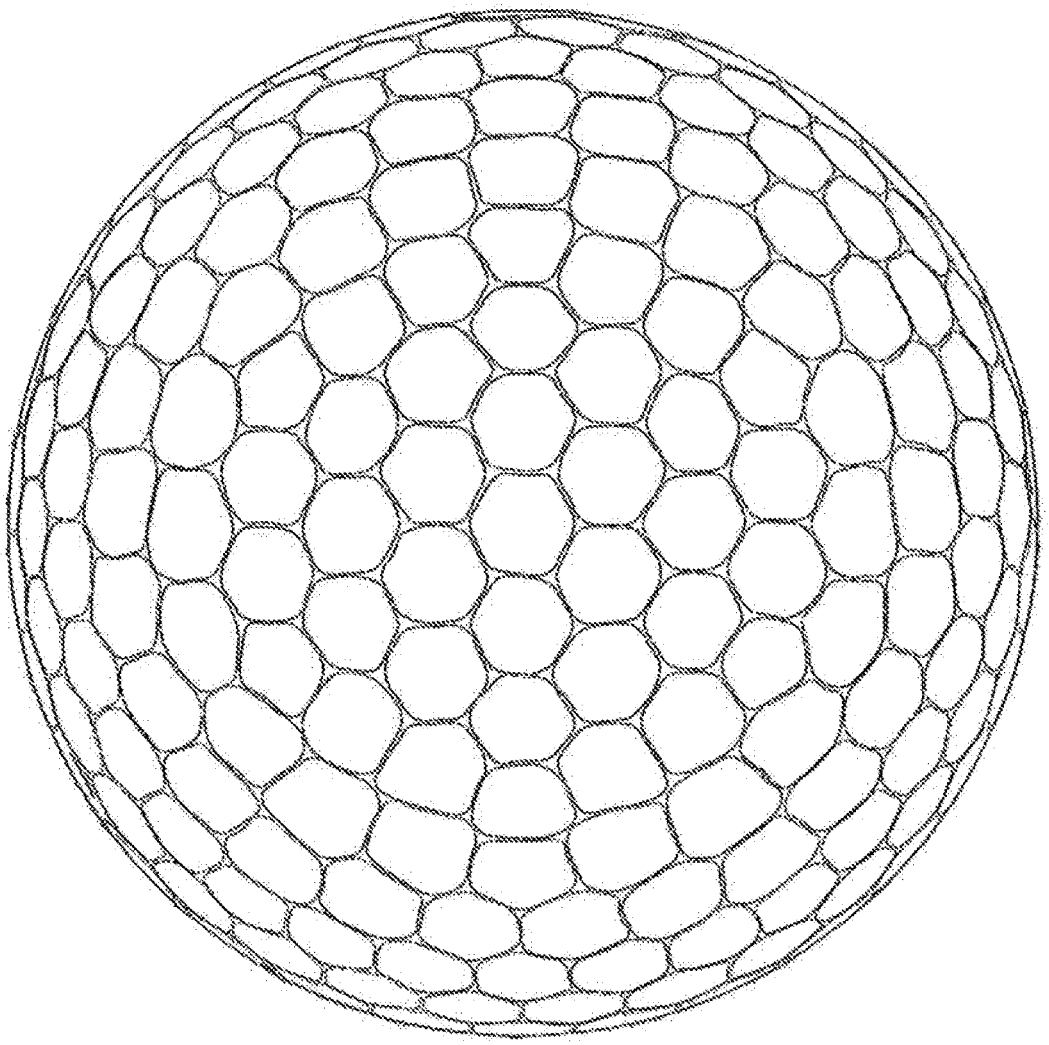
FIG. 6 is a plan view of the golf ball in FIG. 5.

Golf balls of Examples 4 to 7 were obtained in the same manner as Example 1, except a dimple pattern a front view of which is shown in FIG. 5 and a plan view of which is shown in FIG. 6 was used.

Example 8

Figure 7:
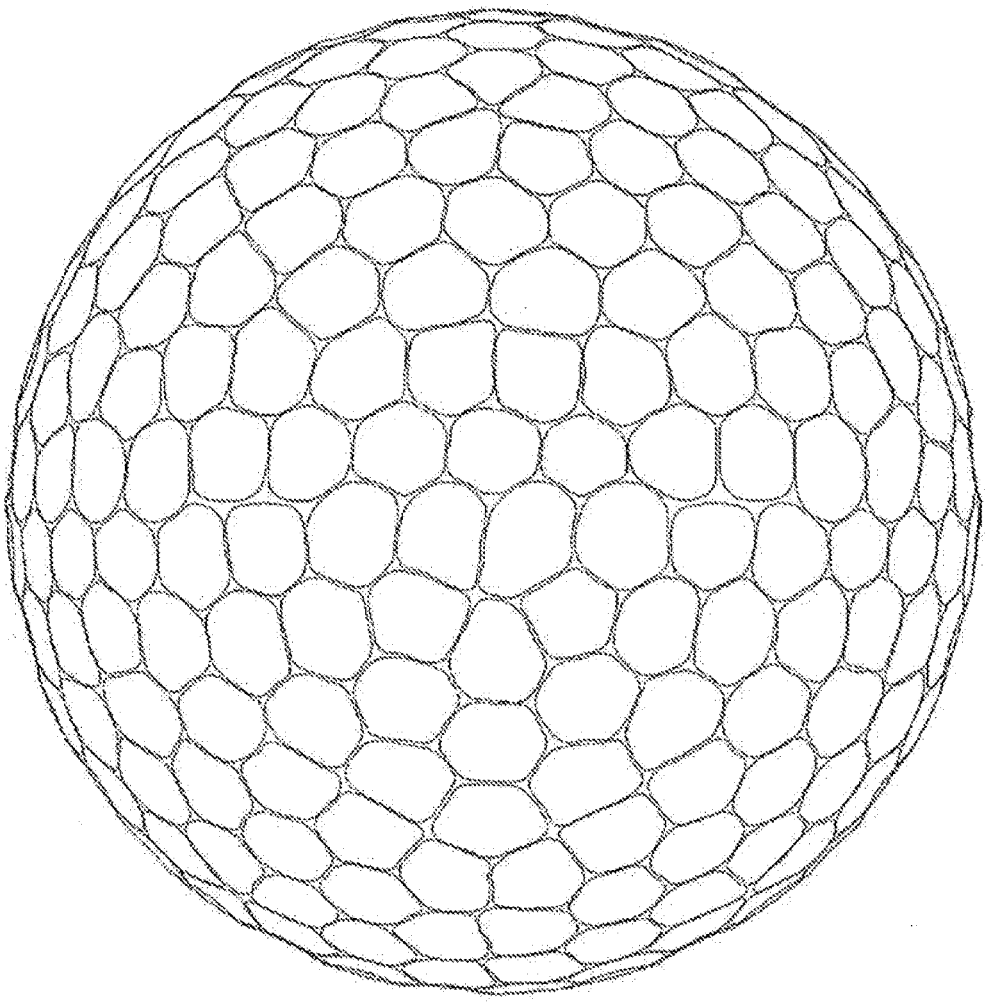
FIG. 7 is a front view of a golf ball according to Example 8 of the present invention.
Figure 8:
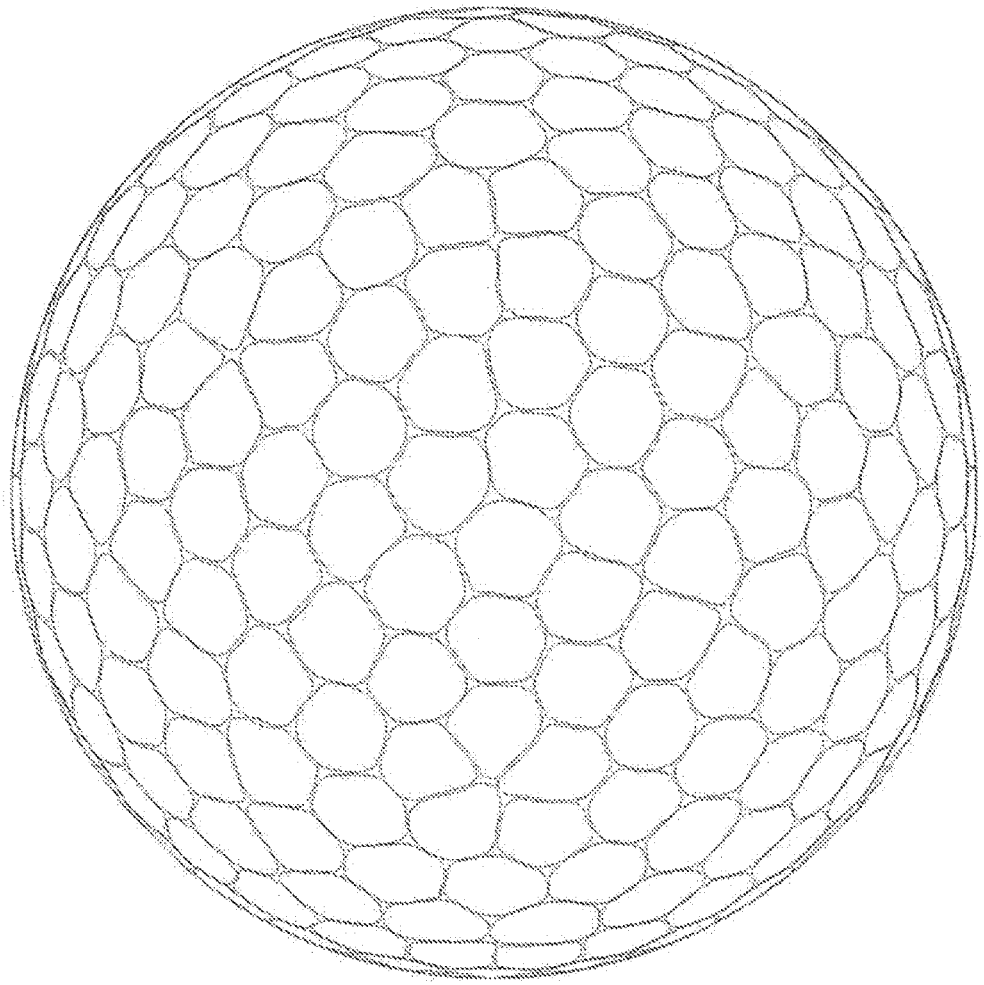
FIG. 8 is a plan view of the golf ball in FIG. 7.

A golf ball of Example 8 was obtained in the same manner as Example 1, except a dimple pattern a front view of which is shown in FIG. 7 and a plan view of which is shown in FIG. 8 was used.

Experiment 1

A driver with a head made of a titanium alloy (trade name "XXIO", manufactured by DUNLOP SPORTS CO. LTD., shaft hardness: R, loft angle: 11°) was attached to a swing machine manufactured by Golf Laboratories, Inc. A golf ball was hit under the conditions of: a head speed of 40 m/sec; and a backspin rate of about 2820 rpm, and the distance from the launch point to the stop point was measured. At the test, the weather was almost windless. The average value of data obtained by 20 measurements is shown in Tables 3 to 5 below.

Experiment 2

The average value of flight distances was obtained in the same manner as Experiment 1, except a golf ball was hit under a condition of a backspin rate of about 1740 rpm. The results are shown in Tables 3 to 5 below.

[Calculation of Difference in Flight Distance]

The difference between the average value of flight distances obtained in Experiment 1 and the average value of flight distances obtained in Experiment 2 was calculated. The absolute value of the difference is shown in Tables 3 to 5 below.

TABLE 1

Specifications of Dimples

| | Type | Number | Diameter (mm) | Depth (mm) | Volume ($mm^3$) |
|---|---|---|---|---|---|
| Comp. Ex. 1 | A | 42 | 4.60 | 0.224 | 1.865 |
| | B | 72 | 4.40 | 0.214 | 1.626 |
| | C | 66 | 4.20 | 0.183 | 1.272 |
| | D | 126 | 4.00 | 0.164 | 1.030 |
| | E | 12 | 3.90 | 0.149 | 0.892 |
| | F | 12 | 2.60 | 0.100 | 0.265 |
| Comp. Ex. 2 | A | 42 | 4.60 | 0.244 | 2.032 |
| | B | 72 | 4.40 | 0.234 | 1.778 |
| | C | 66 | 4.20 | 0.203 | 1.411 |
| | D | 126 | 4.00 | 0.184 | 1.156 |
| | E | 12 | 3.90 | 0.169 | 1.011 |
| | F | 12 | 2.60 | 0.120 | 0.318 |
| Comp. Ex. 3 | A | 42 | 4.60 | 0.264 | 2.198 |
| | B | 72 | 4.40 | 0.254 | 1.931 |
| | C | 66 | 4.20 | 0.223 | 1.550 |
| | D | 126 | 4.00 | 0.204 | 1.282 |
| | E | 12 | 3.90 | 0.189 | 1.131 |
| | F | 12 | 2.60 | 0.140 | 0.371 |
| Ex. 1 | A | 42 | 4.60 | 0.274 | 2.282 |
| | B | 72 | 4.40 | 0.264 | 2.007 |
| | C | 66 | 4.20 | 0.233 | 1.619 |
| | D | 126 | 4.00 | 0.214 | 1.345 |
| | E | 12 | 3.90 | 0.199 | 1.191 |
| | F | 12 | 2.60 | 0.150 | 0.398 |

TABLE 2

Specifications of Dimples

| | Type | Number | Diameter (mm) | Depth (mm) | Volume ($mm^3$) |
|---|---|---|---|---|---|
| Ex. 2 | A | 42 | 4.60 | 0.284 | 2.365 |
| | B | 72 | 4.40 | 0.274 | 2.083 |
| | C | 66 | 4.20 | 0.243 | 1.689 |
| | D | 126 | 4.00 | 0.224 | 1.408 |
| | E | 12 | 3.90 | 0.209 | 1.251 |
| | F | 12 | 2.60 | 0.160 | 0.425 |
| Ex. 3 | A | 42 | 4.60 | 0.294 | 2.449 |
| | B | 72 | 4.40 | 0.284 | 2.160 |
| | C | 66 | 4.20 | 0.253 | 1.759 |
| | D | 126 | 4.00 | 0.234 | 1.471 |
| | E | 12 | 3.90 | 0.219 | 1.311 |
| | F | 12 | 2.60 | 0.170 | 0.451 |
| Comp. Ex. 4 | A | 42 | 4.60 | 0.334 | 2.783 |
| | B | 72 | 4.40 | 0.324 | 2.466 |
| | C | 66 | 4.20 | 0.293 | 2.038 |
| | D | 126 | 4.00 | 0.274 | 1.724 |
| | E | 12 | 3.90 | 0.259 | 1.551 |
| | F | 12 | 2.60 | 0.210 | 0.559 |

TABLE 3

Results of Evaluation

| | Comp. Ex. 1 | Comp. Ex. 2 | Comp. Ex. 3 | Ex. 1 |
|---|---|---|---|---|
| Front view | FIG. 2 | FIG. 2 | FIG. 2 | FIG. 2 |
| Plan view | FIG. 3 | FIG. 3 | FIG. 3 | FIG. 3 |
| Total volume ($mm^3$) | 423 | 468 | 513 | 536 |
| CL1 | 0.301 | 0.271 | 0.252 | 0.211 |
| CL2 | 0.210 | 0.190 | 0.177 | 0.153 |
| L1 | 1.433 | 1.426 | 1.421 | 1.381 |
| CL3 | 0.241 | 0.221 | 0.196 | 0.180 |
| CL4 | 0.165 | 0.154 | 0.145 | 0.137 |
| L2 | 1.461 | 1.441 | 1.351 | 1.314 |
| L1/L2 | 0.981 | 0.990 | 1.052 | 1.051 |
| Flight distance (m) | | | | |

TABLE 3-continued

| Results of Evaluation | | | | |
|---|---|---|---|---|
| | Comp. Ex. 1 | Comp. Ex. 2 | Comp. Ex. 3 | Ex. 1 |
| Experiment 1 | 164 | 168 | 172 | 180 |
| Experiment 2 | 153 | 159 | 164 | 182 |
| Difference | 11 | 9 | 8 | 2 |

TABLE 4

| Results of Evaluation | | | | |
|---|---|---|---|---|
| | Ex. 2 | Ex. 3 | Comp. Ex. 4 | Ex. 4 |
| Front view | FIG. 2 | FIG. 2 | FIG. 2 | FIG. 5 |
| Plan view | FIG. 3 | FIG. 3 | FIG. 3 | FIG. 6 |
| Total volume ($mm^3$) | 558 | 581 | 672 | 630 |
| CL1 | 0.198 | 0.197 | 0.182 | 0.210 |
| CL2 | 0.147 | 0.145 | 0.142 | 0.152 |
| L1 | 1.348 | 1.355 | 1.286 | 1.380 |
| CL3 | 0.171 | 0.170 | 0.155 | 0.177 |
| CL4 | 0.131 | 0.131 | 0.126 | 0.142 |
| L2 | 1.303 | 1.292 | 1.230 | 1.247 |
| L1/L2 | 1.035 | 1.049 | 1.045 | 1.107 |
| Flight distance (m) | | | | |
| Experiment 1 | 183 | 185 | 181 | 181 |
| Experiment 2 | 185 | 188 | 192 | 181 |
| Difference | 2 | 3 | 11 | 0 |

TABLE 5

| Results of Evaluation | | | | |
|---|---|---|---|---|
| | Ex. 5 | Ex. 6 | Ex. 7 | Ex. 8 |
| Front view | FIG. 5 | FIG. 5 | FIG. 5 | FIG. 7 |
| Plan view | FIG. 6 | FIG. 6 | FIG. 6 | FIG. 8 |
| Total volume ($mm^3$) | 645 | 700 | 715 | 600 |
| CL1 | 0.206 | 0.205 | 0.202 | 0.218 |
| CL2 | 0.150 | 0.149 | 0.147 | 0.160 |
| L1 | 1.374 | 1.375 | 1.374 | 1.363 |
| CL3 | 0.175 | 0.178 | 0.174 | 0.184 |
| CL4 | 0.140 | 0.141 | 0.138 | 0.146 |
| L2 | 1.253 | 1.259 | 1.263 | 1.259 |
| L1/L2 | 1.097 | 1.092 | 1.088 | 1.083 |
| Flight distance (m) | | | | |
| Experiment 1 | 181 | 183 | 182 | 182 |
| Experiment 2 | 182 | 187 | 188 | 184 |
| Difference | 1 | 5 | 6 | 2 |

As shown in Tables 3 to 5, the golf ball of each Example has a small difference in flight distance. From the results of evaluation, advantages of the present invention are clear.

The aforementioned dimples are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball having a large number of dimples on a surface thereof, the golf ball meeting the following mathematical formula (I):

$$1.348 \leq L1 \leq 1.381 \quad \text{(I)},$$

where L1 represents a ratio of a lift coefficient CL1 which is measured under conditions of a Reynolds number of $1.290\times10^5$ and a spin rate of 2820 rpm, relative to a lift coefficient CL2 which is measured under conditions of a Reynolds number of $1.290\times10^5$ and a spin rate of 1740 rpm, wherein:

a total volume of the dimples is equal to or greater than 520 $mm^3$ but equal to or less than 720 $mm^3$, a ratio of a sum of spherical surface areas of the dimples relative to a surface area of a phantom sphere of the golf ball is equal to or greater than 0.780 but equal to or less than 0.950, a total number of the dimples is equal to or greater than 250 but equal to or less than 450, each dimple has a diameter of equal to or greater than 2.0 mm but equal to or less than 6.0 mm, and each dimple has a depth of equal to or greater than 0.10 mm but equal to or less than 0.60 mm.

2. The golf ball according to claim 1, wherein the golf ball meets the following mathematical formula (II):

$$1.240 \leq L2 \leq 1.340 \quad \text{(II)},$$

where L2 represents a ratio of a lift coefficient CL3 which is measured under conditions of a Reynolds number of $1.771\times10^5$ and a spin rate of 2940 rpm, relative to a lift coefficient CL4 which is measured under conditions of a Reynolds number of $1.771\times10^5$ and a spin rate of 1800 rpm.

3. The golf ball according to claim 2, wherein a ratio (L1/L2) of the L1 relative to the L2 is equal to or greater than 1.000.

4. The golf ball according to claim 3, wherein the ratio (L1/L2) is equal to or greater than 1.060.

* * * * *